US006905423B2

(12) United States Patent
Morgan et al.

(10) Patent No.: US 6,905,423 B2
(45) Date of Patent: Jun. 14, 2005

(54) MULTI-LAYER GOLF BALL

(75) Inventors: William E. Morgan, Barrington, RI (US); Kevin M. Harris, New Bedford, MA (US); Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/194,291

(22) Filed: Jul. 15, 2002

(65) Prior Publication Data

US 2002/0187859 A1 Dec. 12, 2002

Related U.S. Application Data

(60) Division of application No. 09/767,723, filed on Jan. 24, 2001, now abandoned, which is a continuation-in-part of application No. 09/243,455, filed on Feb. 3, 1999, now abandoned.

(51) Int. Cl.[7] ..... A63B 37/04; A63B 37/06
(52) U.S. Cl. ..... 473/376; 473/371
(58) Field of Search ..... 473/351–377

(56) References Cited

U.S. PATENT DOCUMENTS

| | | | | |
|---|---|---|---|---|
| 2,541,851 | A | 2/1951 | Wright | 260/37 |
| 4,371,636 | A | 2/1983 | Distler et al. | 523/223 |
| 4,465,572 | A | 8/1984 | Graham | 204/159.16 |
| 4,536,310 | A | 8/1985 | Agarwal et al. | 252/33 |
| 4,654,396 | A | 3/1987 | Bung et al. | 524/401 |
| 4,829,093 | A | 5/1989 | Matsukawa et al. | 521/53 |
| 5,021,170 | A | 6/1991 | Shumate et al. | 252/8.515 |
| 5,037,880 | A | 8/1991 | Schmidt et al. | 524/823 |
| 5,171,766 | A | 12/1992 | Mariano et al. | 523/218 |
| 5,184,828 | A | 2/1993 | Kim et al. | |
| 5,202,362 | A | 4/1993 | Hermele | 523/218 |
| 5,234,988 | A | 8/1993 | Brooks et al. | 524/526 |
| 5,364,892 | A | 11/1994 | Miller et al. | 523/218 |
| 5,467,994 | A | 11/1995 | Mooriyama et al. | |
| 5,498,645 | A | 3/1996 | Mariano et al. | 523/218 |
| 5,506,280 | A | 4/1996 | Miller et al. | 523/218 |
| 5,607,993 | A | 3/1997 | Christy | 524/237 |
| 5,679,735 | A | 10/1997 | Geissler et al. | 524/459 |
| 5,683,312 | A | 11/1997 | Boehm et al. | 473/354 |
| 5,698,616 | A | 12/1997 | Baker et al. | 523/201 |
| 5,733,428 | A | 3/1998 | Calabria et al. | 264/134 |
| 5,772,531 | A | 6/1998 | Ohsumi et al. | 473/376 |
| 5,779,562 | A | 7/1998 | Melvin et al. | 473/373 |
| 5,827,459 | A | 10/1998 | Allen et al. | 264/46.4 |
| 5,883,382 | A | 3/1999 | Asada | 250/214.1 |
| 5,885,172 | A | 3/1999 | Hebert et al. | 473/354 |
| 5,895,805 | A | 4/1999 | Darling | 523/218 |
| 5,919,100 | A | 7/1999 | Boehm et al. | 473/354 |
| 5,947,843 | A | 9/1999 | Calabria et al. | 473/377 |
| 5,965,669 | A | 10/1999 | Cavallaro et al. | 525/221 |
| 5,967,907 | A | 10/1999 | Takemura et al. | 473/373 |

(Continued)

FOREIGN PATENT DOCUMENTS

| | | |
|---|---|---|
| JP | 08-322964 | 12/1996 |
| JP | 10-127819 | 5/1998 |
| WO | WO 00/45899 | 8/2000 |

*Primary Examiner*—Gregory Vidovich
*Assistant Examiner*—Alvin A. Hunter, Jr.
(74) *Attorney, Agent, or Firm*—Swidler Berlin LLP

(57) ABSTRACT

The present invention relates to a golf ball that provides improved playing characteristics by providing a cushioning interface between a center and subsequent layers. The ball can include a center, a soft intermediate layer, and a cover, although various constructions and modifications are possible. The intermediate layer can include an elastomeric latex or solution that will dry to form a soft film on the surface of the center. Such a soft rubber interlayer can serve as a cushioning interface to help improve durability and softness of the ball upon club impact. In another embodiment, the thin intermediate layer includes a responsive viscoelastic composition that exhibits an increase in viscosity under shear forces.

39 Claims, 4 Drawing Sheets

U.S. PATENT DOCUMENTS 5,971,871 A 10/1999 Sullivan et al. ..... 473/373
5,972,092 A 10/1999 Cordova ..... 106/126.3
5,989,136 A * 11/1999 Renard et al. ..... 473/376
6,123,628 A 9/2000 Ichikawa et al. ..... 473/371
6,127,457 A 10/2000 Darling ..... 523/218
6,159,110 A 12/2000 Sullivan et al. ..... 473/374
6,162,134 A 12/2000 Sullivan et al. ..... 473/373
6,294,617 B1 9/2001 Rajagopalan ..... 525/425
6,299,550 B1 * 10/2001 Molitor et al. ..... 473/354
6,315,680 B1 11/2001 Dalton et al. ..... 473/373
6,394,913 B1 * 5/2002 Nesbitt et al. ..... 473/371
6,394,914 B1 * 5/2002 Sullivan ..... 473/376
6,413,172 B1 * 7/2002 Binette ..... 473/378
6,425,833 B1 * 7/2002 Sullivan et al. ..... 473/373
6,520,870 B2 * 2/2003 Tzivanis et al. ..... 473/371
6,612,940 B1 * 9/2003 Nesbitt et al. ..... 473/376

* cited by examiner

MULTI-LAYER GOLF BALL

CROSS-REFERENCE TO RELATED APPLICATION

This application is a divisional of application Ser. No. 09/767,723, filed Jan. 24, 2001 now abandoned, which is a continuation-in-part of application Ser. No. 09/243,455, filed Feb. 3, 1999, now abandoned, the disclosure of which is incorporated herein by express reference thereto.

FIELD OF THE INVENTION

The present invention relates to a multi-layer golf ball and methods for forming a portion thereof including a core having a center with at least one center layer, a mantle having at least one mantle layer of a resilient polymer component disposed concentrically about the center, a soft, thin intermediate layer disposed preferably between the center and the mantle, and at least one cover layer disposed concentrically adjacent the core. The invention also relates to the polymeric composition used in forming the intermediate layer. In another embodiment, the thin intermediate layer includes a responsive viscoelastic composition that exhibits an increase in viscosity under shear forces.

BACKGROUND OF THE INVENTION

Generally, golf balls have been classified as solid balls or wound balls. Solid balls are generally comprised of a solid polymeric core and a cover. These balls are generally easy to manufacture, but are regarded as having limited playing characteristics. Wound balls are comprised of a solid or liquid filled center surrounded by tensioned elastomeric material and a cover. Wound balls generally have a good playing characteristics, but are more difficult to manufacture than solid balls.

The prior art is comprised of various golf balls that have been designed to provide optimal playing characteristics. These characteristics are generally the initial velocity and spin of the golf ball, which can be optimized for various players. For instance, certain players prefer to play a ball that has a high spin rate for playability. Other players prefer to play a ball that has a low spin rate to maximize distance. However, these balls tend to be hard feeling and difficult to control around the greens. Therefore, attempts to create a golf ball that couples the production ease of a solid ball with the beneficial playing characteristics of a wound ball, have been numerous.

A Japanese Publication No. 10127819 is directed towards a method for constructing a solid golf ball that provides a "soft" ball-hitting touch. The golf ball consists of a solid core of a three layer structure comprising an internal layer, an intermediate layer, and a cover layer, and a cover over the solid core. The internal layer of the three-layer structure is set to a JIS-C hardness of 40–90, the intermediate layer is made up of a thermoplastic resin composition to be set to a JIS-C hardness of 50–80, and the cover layer is set to a JIS-C hardness of 65 or more.

Another reference, U.S. Pat. No. 5,184,828 discloses a dual core golf ball whose core has a maximum hardness at the surface of the inner core and then increases in hardness from the surface of the inner core to the center of the inner core and from the surface of the inner core through the body of the outer core. Specific hardness ranges for each location are specified but the patent does not address the use of soft elastomeric film between layers.

Similarly, Japanese Patent Application No. 8-322964A of Kasco Corporation discloses a dual core ball whose core has an increasing hardness gradient, requiring that the inner surface of the outer core be harder than the remainder of the outer core.

The prior art additionally discloses a number of methods for the manufacture of golf balls employing a soft elastomeric film (such as a latex dip) on wound constructions. U.S. Pat. No. 5,733,428 discloses the use of latex dips within the body of a wound core to produce multilayer wound cores. The prior art also discloses the concept of a coating between the core and the outer cover of the ball; the coatings were comprised of fully-cured epoxy or other adhesive material to help increase core to cover adhesion.

However, none of these patents disclose or even suggest a nonwound, dual, multicore or liquid-center ball having the materials and material property requirements as disclosed herein, specifically the use of a soft, intermediate layer between the inner sphere and subsequent mantle layers, to provide the improved balls of the present invention. The softer, rubber interlayer can serve as a cushioning interface to improve the overall softness of the ball, as well as the fracture durability.

SUMMARY OF THE INVENTION

The present invention relates to a golf ball, and more particularly golf balls that have a multilayer core that provides improved playing characteristics by providing a cushioning interface between the center and any subsequent layers. The ball is comprised of a center; a soft, thin, elastomer latex intermediate layer around the center wherein the intermediate layer is less than about 0.01 inches thick and has a flexural modulus of less than about 10,000 psi; one or more mantle layers disposed concentrically adjacent the intermediate layer, wherein the mantle layer material comprises a resilient polymer component; and a cover layer disposed concentrically around the mantle.

Any soft, elastomeric latex or solution that will dry to form a soft film on the surface of the center or other subsequent mantle layers, can be employed as the intermediate layer. Typical thermosetting latex materials which can be used to coat the cores include low ammonia natural latex and/or pre-vulcanized natural latex. Natural latex is noted for its combination of high tensile strength, excellent elasticity, tack, low modulus, and ability to form strong, coherent, wet and dry films. Natural rubber latex is also relatively inert, nontoxic, cost effective, compatible with most core and outer shell rubber compounds, and can be air dried.

A preferred latex material is a partially pre-vulcanized natural latex that can be diluted with water to any solid content. It is understood that non-latex encapsulating materials may also be used. Such materials include elastomer adhesives as well as aqueous and non-aqueous adhesives, urethane dispersions, synthetic latexes, and alkyd resins. Other materials that could be suitable for the soft, intermediate layer, include aqueous acrylic and latex copolymers, and polyurethane coatings and preparations. The soft intermediate layer may also contain additives, fillers, thickeners, or a combination thereof, to adjust the specific gravity of the layer to alter various golf ball properties as needed or desired.

A natural rubber latex, when dried, is softer than either the inner or outer core compounds conventionally employed in golf ball manufacture. This property is particularly evident when the inner and outer core compounds are crosslinked and the latex is not. A soft rubber interlayer can serve as a cushioning interface to help improve durability and softness of the ball upon club impact. A soft rubber interlayer also serves to improve fracture durability, particularly when a strong adhesion between the center and mantle layers does not exist. In one embodiment of the present invention, the intermediate layer thickness is from about 0.0005 to 0.01 inches. Preferably, the intermediate layer thickness is from about 0.0008 to 0.01 inches. In another embodiment, the intermediate layer has a Shore A hardness of less than about 90. In a preferred embodiment, the intermediate layer has a Shore A hardness of less than about 70. Alternatively, the flexural modulus of the intermediate layer is less than about 3,000 psi.

The inner sphere, or center, may be of any dimension or composition, such as a thermoset solid rubber sphere, a thermoplastic solid sphere, wood, cork, metal, or any material known to one skilled in the art of ball manufacture. Preferably, the solid inner sphere is comprised of a resilient polymer such as polybutadiene, natural rubber, polyisoprene, styrene-butadiene, or styrene-propylene-diene rubber. Similarly, the inner sphere could be a fluid-filled sphere such as a rubber sack, a thermoplastic, or metallic shell design, in which the fluid could be of any composition or viscosity available to those of ordinary skill in the art. It is also feasible to construct such a center with a void or gas center. In one embodiment, the center has an outer diameter of about 0.5 to 1.50 inches. Preferably, the center outer diameter is about 0.75 to 1.25 inches. In another embodiment, the combination of the center, the soft elastic intermediate layer, and the mantle has an outer diameter of about 1.45 to 1.6 inches. Preferably, the combination of the center, the soft elastic intermediate layer, and the mantle has an outer diameter of about 1.5 to 1.58 inches. In another embodiment, the center can be filled with a fluid such as a liquid or a gas, a gel, or a cellular foam.

In still another embodiment, the intermediate layer is comprised of low ammonia natural latex and/or prevulcanized natural latex, elastomer adhesives, synthetic latexes, acrylic esters, alkyd resins, or mixtures thereof. Preferably, the soft intermediate layer is comprised of a natural or a synthetic latex.

In the current invention, a mantle comprising at least one layer, the layer comprising a resilient polymer component, is disposed concentrically around the intermediate layer. The mantle layer may contain a reinforcing polymer. Reinforcing polymer components, such as transpolyisoprene, block copolymer ether/ester, acrylic polyol, a polyethylene, a polyethylene copolymer, 1,2-polybutadiene (syndiotactic), ethylene-vinyl acetate copolymer, cyclooctene, trans-polybutadiene, and mixtures thereof, should have a glass transition temperature sufficiently low enough to avoid causing crosslinking or thermal degradation of the resilient polymer. Alternatively, the resilient polymer component of the mantle layer comprises polybutadiene, natural rubber, polyisoprene, styrene-butadiene, or styrene-propylene-diene rubber, or a mixture thereof. In one embodiment, the resilient polymer component of the solid center comprises polybutadiene, natural rubber, polyisoprene, styrene-butadiene, or styrene-propylene-diene rubber, or a mixture thereof. Preferably, the resilient polymer component comprises 1,4-cis-polybutadiene having a molecular weight average of about 50,000 to about 1,000,000. The amount of resilient polymer component of the mantle layer is between about 60 to about 99 weight percent of the total weight of polymer components. The mantle layer preferably has a flexural modulus of greater than about 3.5 MPa. Similarly, the golf ball further includes at least one of a filler, a free-radical initiator, or a crosslinking agent.

The present invention also provides a method for making a golf ball having a multi-layer core comprising forming an inner sphere; forming a soft, elastic, intermediate layer around the inner sphere wherein the intermediate layer is less than about 0.01-in thick and has a flexural modulus of less than about 10,000 psi; molding apart from the inner sphere and intermediate layer, and from elastomeric material two substantially hemispherical cups having substantially hemispherical cavities; placing the inner sphere and intermediate layer between the two cups within the cavities; joining the cups to form the golf ball core having an inner sphere, soft intermediate layer, and an outer layer; and forming a cover over the golf ball core.

In a first method, the soft, intermediate layer is formed over the inner sphere by a dipping method. The inner sphere is lowered into a bath of latex or other soft material that is of the correct viscosity and percent solids to leave a very thin layer of material, of substantially uniform thickness, encompassing the inner sphere. In a second method, the soft, intermediate layer may be applied by a spraying process in which the latex is applied through a nozzle, evenly coating the surface of the inner sphere.

Further, the molding of the cups preferably comprises compression molding first and second cups from the elastomeric material on opposite sides of a single mold part. The center, which has been coated with soft latex by a dipping or spraying process, is placed between the two cups, which are then joined at an elevated temperature, causing crosslinking there between, to form an outer layer of the core. Alternatively, the latex dip can be disposed on an inner cover layer of a golf ball. The step of joining the cups comprises adhesively attaching the cups to each other. When the cups are joined, the hemispherical cavities together form a spherical cavity, now occupied by the center or inner sphere, and the cups themselves form the outer layer of the core. Thus, the center is easily positioned concentrically within the finished ball. In another embodiment, the joining of the cups is achieved by compression molding. In still another embodiment, molding further comprises molding nonplanar mating surfaces on the cups adjacent the cavities, wherein joining the cups comprises meshing the mating surfaces.

Finally, a cover is molded around the core. Any process that results in accurate and repeatable central placement of the core within the cover is acceptable. Generally, covers are applied by compression molding, injection molding or casting cover material over the core.

The present invention further provides a golf ball, comprising a solid center having a first hardness; an intermediate layer formed over the solid center having a second hardness less than the first; an outer layer formed over the intermediate layer having a third hardness greater than the first hardness; and a cover. Preferably, the first hardness is between about 20 and 40 Shore D, the second hardness is less than about 20 Shore D, and the third hardness is greater than about 50 Shore D.

The invention also relates to a multi-layer golf ball including a core having at least one layer; a cover disposed concentrically about the core and having at least one layer; and an intermediate layer formed of a responsive viscoelastic composition disposed between the core and the at least one cover layer. The responsive viscoelastic composition includes at least one material that has a dilatant or thixotropic viscosity, i.e., exhibits an increase in viscosity in response to pressure such as shear forces.

In one embodiment, the intermediate layer is less than about 0.01 inches thick. In one preferred embodiment, the intermediate layer is from about 0.0005 to 0.01 inches thick. In one more preferred embodiment, the intermediate layer is from about 0.0008 to 0.002 inches thick.

In another embodiment, the intermediate layer is from about 0.01 to 0.1 inches thick. In one preferred embodiment, the intermediate layer is from about 0.01 to 0.03 inches thick.

In one embodiment, the intermediate layer is disposed between two cover layers. In another embodiment, the intermediate layer is disposed between the core and a second intermediate layer. In yet another embodiment, the intermediate layer has a plasticity of about 20 mils to 150 mils. In one preferred embodiment, the intermediate layer has a plasticity of about 60 mils to 120 mils.

In one embodiment, the intermediate layer includes a solid, semi-solid, gel, or gel-like material. In one preferred embodiment, the material can include at least one of polydimethyl siloxane, dimethyl cyclosiloxane, a hydroxy-terminated polydimethyl siloxane, polyvinyl alcohol, an acrylic plastisol, an acrylic organosol, a hydrocarbon-based gel, a sulfonate ionomer, butyl rubber ionomer, an ionized crosslinked polyacrylamide gel, a microporous fast-response gel, a thermoplastic elastomer gel, or a blend thereof. In particular, one suitable blend is a blend of at least one hydrocarbon-based gel with at least one sulfonate ionomer.

In one embodiment, the intermediate layer material has a hardness of less than about 90 Shore A. In one preferred embodiment, the material has a hardness of less than about 70 Shore A. In one embodiment, the cover has a thickness of about 0.02 to 0.1 inches.

BRIEF DESCRIPTION OF DRAWINGS

Further features and advantages of the invention can be ascertained from the following detailed description provided in connection with the drawing(s) described below.

DEFINITIONS

The term "about," as used herein, should be understood to refer to both numbers in a range of numbers.

As used herein, the term "fluid" includes a liquid, a paste, a gel, a gas, or any combination thereof.

DETAILED DESCRIPTION OF THE INVENTION

Figure 1:
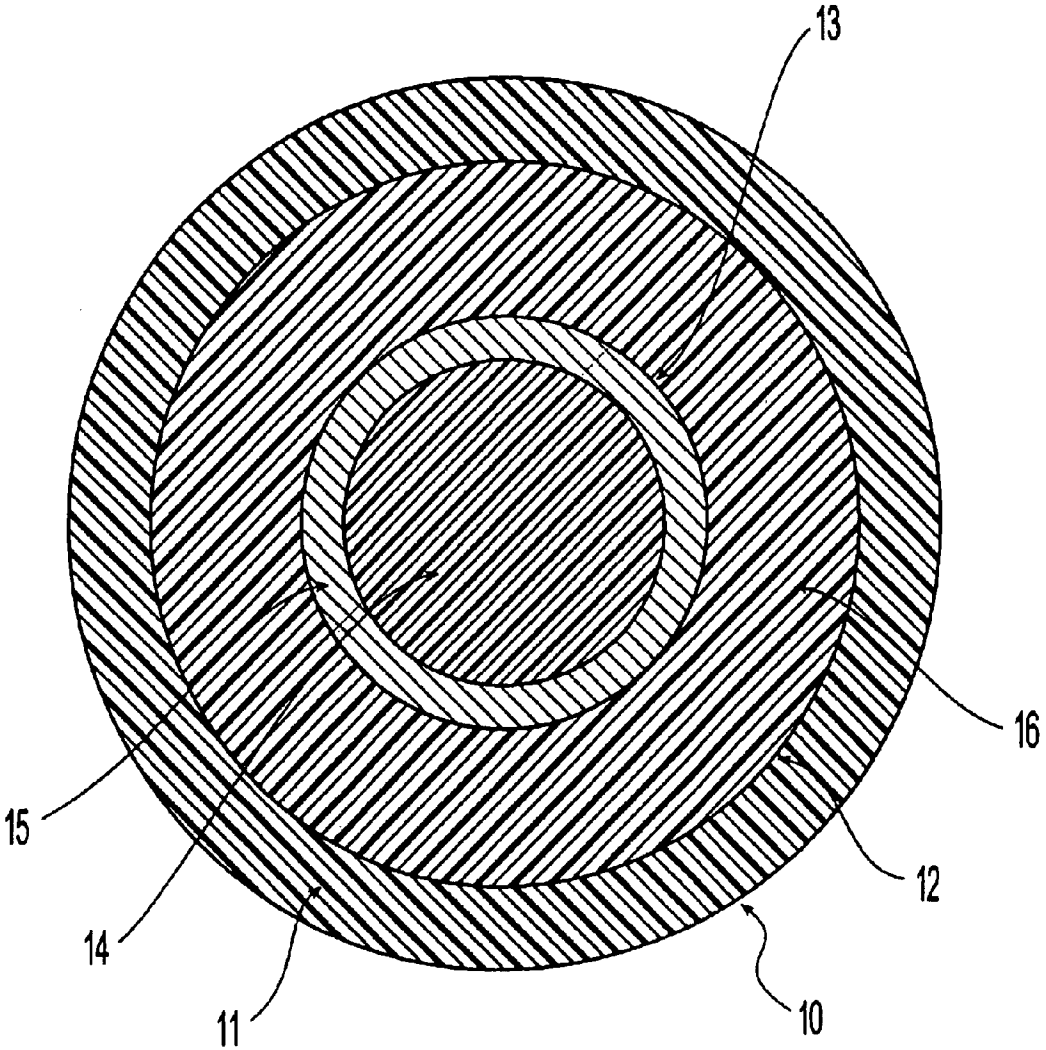
FIG. 1 is a sectional view of the ball of the present invention.

Referring to FIG. 1, ball 10 includes a cover 11 and a core 12. The core 12 has a center or inner sphere 13 that is disposed concentrically therein and can be comprised of a solid or fluid-filled center 14 in a cavity within a soft intermediate layer 15. The core 12 may also have an outer mantle 16, which surrounds the inner sphere 13. The solid center of the ball is typically and preferably spherical, may be solid or fluid-filled, and is generally about 0.5 inches to 1.5 inches, preferably about 0.5 inches to 1.35 inches, and more preferably about 0.75 to 1.25 inches in diameter. The soft intermediate layer can have a thickness of about 0.0005 to 0.010 inches, preferably about 0.0008 to 0.005 inches. The mantle can have a thickness of about 0.1 to 0.6 inches, preferably about 0.15 to 0.35 inches, more preferably about 0.2 to 0.3 inches. The entire core, including the center, soft intermediate layer, and mantle, can have a diameter of about 1.45 to 1.60 inches, preferably about 1.50 to 1.58 inches. The diameters of the soft intermediate layer and mantle corresponding to a particular center, and of the cover formed around the mantle and center, may be adjusted according to the diameter of the center to provide a golf ball formed according to the invention with the overall minimum diameter required by the USGA.

The central sphere, or center, may be of any dimension or composition. It could be a thermoset solid rubber sphere, a thermoplastic solid sphere, wood, cork, metal, or any material known to one skilled in the art of ball manufacture. Similarly it could be a fluid-filled sphere such as a rubber sack, a thermoplastic, or metallic shell design. A liquid of any composition or viscosity known to those of ordinary skill in the art could be included. It is also feasible to construct such a center with a void or "gas" center.

A representative and preferred base composition for forming the golf ball center 13, prepared in accordance with the present invention, comprises polybutadiene and, in parts by weight based on 100 parts polybutadiene, 20–50 parts of a metal salt diacrylate, dimethacrylate, or monomethacrylate, preferably zinc diacrylate. The polybutadiene preferably has a cis-1,4-polybutadiene content of above about 90% and more preferably above about 96%. Commercial sources of polybutadiene include "CARIFLEX" BR 1220 manufactured by Shell Chemical, "NEOCIS" BR40 manufactured by Enichem Elastomers, and "UBEPOL" BR150 manufactured by Ube Industries, Ltd. If desired, the polybutadiene can also be mixed with other elastomers known in the art, such as natural rubber, styrene butadiene, and/or isoprene in order to further modify the properties of the center 13. When a mixture of elastomers is used, the amounts of other constituents in the core composition are based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity in the USGA test. Suitable, commercially available zinc diacrylates include those from Sartomer. The preferred concentrations of zinc diacrylate that can be used are about 15 to 30 phr and preferably about 18 to 25 phr based upon 100 phr of polybutadiene or alternately, polybutadiene with a mixture of other elastomers that equal 100 phr.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di (t-butylperoxy) 3,3,5-trimethyl cyclohexane, a—a bis (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 phr and 2.5 phr based upon 100 parts of butadiene, or butadiene mixed with one or more other elastomers. More preferably, the amount of initiator added ranges from about 0.15 phr to 2 phr and most preferably from about 0.25 phr to 2.0 phr.

A typical prior art golf ball core incorporates 5 phr to 50 phr of zinc oxide in a zinc diacrylate-peroxide cure system that cross-links polybutadiene during the core molding process. In the present invention, some of the zinc oxide can be eliminated in favor of calcium oxide in the golf ball core composition. The cores and balls produced from such an admixture typically exhibit enhanced performance properties. The initial velocity of the standard ball is maintained, but the compression of the ball is reduced by at least about 2 compression points on the standard compression scale. On the other hand, the combination of the use of some calcium oxide and a higher percentage of zinc diacrylate can be used to maintain the same compression, but the initial velocity is significantly increased. Where the amount of zinc oxide incorporated in prior art cores is typically about 5 phr to 50 phr, the amount of calcium oxide added to the core-forming composition of the invention as an activator is typically in the range of about 0.1 to 15, preferably about 1 to 10, most preferably about 1.25 to 5, parts calcium oxide per hundred parts of rubber. The compositions of the present invention may also include fillers, added to the elastomeric composition to adjust the density and/or specific gravity of the core. As used herein, the term "fillers" includes any compound or composition that can be used to vary the density and other properties of the subject golf ball core. The fillers useful according to the invention are generally inorganic, and suitable fillers include numerous metals, metal oxides, and inorganic compounds, such as zinc oxide and tin oxide, and barium sulfate, zinc sulfate, calcium carbonate, barium carbonate, clay, tungsten, tungsten oxide, tungsten carbide, an array of silicas, ground particles of cured rubber (which can include recycled core molding matrix ground to about 20 to 40 mesh particle size), coloring agents, and the like. The fillers, when used, may be present in an amount of about 0.5 to 50 weight percent of the composition. The amount and type of filler utilized is partly governed by the amount and weight of other ingredients in the composition, since a maximum golf ball weight of 1.620 oz (45.92 g) has been established by the USGA. Appropriate fillers generally used range in specific gravity from about 2 to 20. In the preferred embodiment, the center contains an amount of filler such that the specific gravity of the center is greater than the specific gravity of the mantle layer.

In the golf ball center 13, as shown in FIG. 1, the preferred range of specific gravities in one embodiment can be from about 1.1 to about 1.7, more preferably in the range of about 1.1 to about 1.4, depending upon the size of the center, soft intermediate layer, cover, mantle layer and finished ball, as well as the specific gravity of the cover and mantle layer.

Antioxidants may also be included in the elastomer centers produced according to the present invention. Antioxidants are compounds which prevent the breakdown of the elastomer. Antioxidants useful in the present invention include, but are not limited to, quinoline type antioxidants, amine type antioxidants, and phenolic type antioxidants.

Other ingredients such as processing aids, processing oils, plasticizers, dyes and pigments, as well as other additives well known to the ordinary-skilled artisan may also be used in the present invention in amounts sufficient to achieve the purpose for which they are typically used.

A center 13 can also be a fluid-filled sphere, filled with a wide variety of materials including air, water solutions, gels, foams, hot-melts, other fluid materials and combinations thereof, as set forth in U.S. Pat. No. 5,683,312 the disclosure of which is incorporated herein by reference thereto.

The half-shells, and resultant mantle, for use in a ball core include a resilient polymer component, which is used as the majority of polymer in the composition and method. Resilient polymers suitable for use in the ball core include polybutadiene, polyisoprene, styrene-butadiene, styrene-propylene-diene rubber (EPDM), and mixtures thereof. The resilient polymer component is preferably polybutadiene and more preferably 1,4-cis-polybutadiene. One example of a 1,4-cis-polybutadiene is "CARIFLEX" BR 1220, commercially available from Shell. The polybutadiene or other resilient polymer component may be produced with any suitable catalyst that results in a predominantly 1,4-cis content, and preferably with a catalyst that provides a high 1,4-cis content and a high molecular weight average, defined as being at least about 50,000 to 1,000,000, preferably from about 250,000 to 750,000, and more preferably from about 200,000 to 325,000. The 1,4-cis component of polybutadiene is generally the predominant portion of the resilient polymer component when polybutadiene is present. "Predominant" or "predominantly" is used herein to mean greater than 50 weight percent. The 1,4-cis component is preferably greater than about 90 weight percent, and more preferably greater than about 95 weight percent, of the polybutadiene component. The resilient polymer component is typically present in an amount of at least about 60 weight percent, preferably about 65 to 99 weight percent, and more preferably about 75 to 90 weight percent of the polymer blend. The term "polymer blend" is used herein to mean the blend of the resilient polymer component and a reinforcing polymer component.

The mantle may also include a reinforcing polymer component which should have a viscosity sufficiently low enough, at the mixing temperature, to permit proper mixing of the two polymer components. The reinforcing polymer component typically has a glass transition temperature, $T_g$, (and if crystalline, a crystalline melting point) sufficiently low to permit mixing with the resilient polymer component while avoiding substantial crosslinking or thermal degradation of the resilient component at the mixing temperature. Examples of polymers suitable for use as the reinforcing polymer component include: transpolyisoprene, block copolymer ether/ester, acrylic polyol, a polyethylene, a polyethylene copolymer, 1,2-polybutadiene (syndiotactic), ethylene-vinyl acetate copolymer, cyclooctene, trans-polybutadiene, and mixtures thereof. Particularly suitable reinforcing polymers include: a transpolybutadiene, such as "FUREN" 88 obtained from Asahi Chemicals of Yako, Kawasakiku, Kawasakishi, Japan; "KURARAY" TP251, a transpolyisoprene commercially available from Kuraray Co. of New York, N.Y. as Kuraray America Co.; "LEVAPREN" 700HV, an ethylene-vinyl acetate copolymer commercially available from Bayer-Rubber Division, Akron, Ohio; and "VESTENAMER" 8012, a cyclooctene commercially available from Hüls America Inc. of Tallmadge, Ohio. Some suitable reinforcing polymer components are listed below with their crystalline melting points and/or $T_g$.

| Polymer Type | Tradename | Crystalline Melt Temperature (° C.) | $T_g$ (° C.) |
|---|---|---|---|
| Transpolyisoprene | KURARAY TP251 | 60 | −59 |
| Transpolybutadiene | FUREN 88 | 84 | −88 |
| Polyethylene | Dow LDPE | 98 | −25 |
| Polyoctene | VESTENAMER 8012 | 54 | −65 |

The reinforcing polymer component is preferably present in an amount sufficient to impart rigidity to the shells during processing, yet not undesirably reduce resilience of the crosslinked polymer blend and thereby have an undesirable effect on the final product. The viscosity of materials suitable for use in the invention may be readily determined by one of ordinary skill in the art. The viscosity can generally be below about 1,000,000 poise to readily permit mixing. When transpolyisoprene is used as the reinforcing polymer component, it is typically present in an amount of about 10 to 40 weight percent, preferably about 15 to 30 weight percent, of the polymer blend. The weight of the reinforcing polymer relative to the total composition generally ranges from about 5 to 25 weight percent, preferably about 10 to 15 weight percent. The uncrosslinked mantle should have a flexural modulus, as measured under ASTM D790M-93, Method II, of greater than about 3.5 MPa, and preferably greater than about 7 MPa. The reinforcing polymer components imparts a degree of rigidity to the shells sufficient to maintain the desired shape until the first mixture is crosslinked.

Suitable crosslinking agents include one or more metallic salts of unsaturated fatty acids or monocarboxylic acids, such as zinc, calcium, or magnesium acrylate salts, and the like. Preferred acrylates include zinc acrylate, zinc diacrylate, and zinc methacrylate. The crosslinking agent is preferably present in an amount sufficient to crosslink the various chains of polymers in the polymer blend to themselves and to each other. The desired elastic modulus for the mantle may be obtained by adjusting the amount of crosslinking by selecting a particular type or amount of crosslinking agent. This may be achieved, for example, by altering the type and amount of crosslinking agent, which method is well known to those of ordinary skill in the art. The crosslinking agent is typically added in an amount from about 1 phr to 50 phr of the polymer blend, preferably about 20 phr to 45 phr, and more preferably about 30 phr to 45 phr, of the polymer blend.

Although not required, a free-radical initiator is preferably included in the composition and method. The free-radical initiator may be any compound or combination of compounds present in an amount sufficient to initiate a crosslinking reaction between a crosslinking agent and the reinforcing and resilient polymer components of the polymer blend. The free-radical initiator is preferably a peroxide. Suitable free-radical initiators include di(2-t-butylperoxyisopropyl)benzene peroxide, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate on calcium silicate, lauroyl peroxide, benzoyl peroxide, t-butyl hydroperoxide, and the like. The free-radical initiator is preferably present in an amount of up to 2 phr, more preferably about 0.2 to 1 phr of the polymer blend.

The resilient polymer component, reinforcing polymer component, free-radical initiator, and any other materials used in forming the golf ball center and core, in accordance with invention, may be combined by any type of mixing known to one of ordinary skill in the art. The optional crosslinking agent, and any other optional additives used to modify the characteristics of the golf ball center, may similarly be combined by any type of mixing. Suitable mixing equipment is well known to those of ordinary skill in the art, such as a Banbury mixer. Conventional mixing speeds for combining polymers are typically used, although the speed is preferably high enough to impart substantially uniform dispersion of the resilient and reinforcing polymer components. On the other hand, the speed should not be too high, as high mixing speeds tend to break down the polymers being mixed and particularly may undesirably decrease the molecular weight of the resilient polymer component. The speed should thus be low enough to avoid high shear, which may result in loss of desirably high molecular weight portions of the resilient polymer component. Also, too high a mixing speed may undesirably result in creation of enough heat to initiate the crosslinking before the preforms are shaped and assembled around a core. The mixing temperature depends upon the type of resilient and reinforcing polymer components, and more importantly, on the type of free-radical initiator. The mixing temperature is preferably higher than the melting temperature of the reinforcing polymer, but not so high as to initiate substantial crosslinking. For example, when using di(2-t-butyl-peroxyisopropyl) benzene peroxide as the free-radical initiator, a mixing temperature of about 80° C. to 125° C., preferably about 88° C. to 110° C., and more preferably about 90° C. to 100° C. is suitable to safely mix the ingredients. The mixing speed and temperature are readily determinable by one of ordinary skill in the art without undue experimentation.

The mantle layer may alternatively comprise a thermoplastic copolyesterester block copolymer, dynamically vulcanized thermoplastic elastomer, styrene-butadiene elastomer with functional groups such as maleic anhydride or sulfonic acid attached, thermoplastic polyurethane or polymers made using a metallocene catalyst, or blends thereof. Suitable thermoplastic copolyetheresters include "HYTREL" 3078 and "HYTREL" G4078W which are commercially available from DuPont of Wilmington, Del. Suitable dynamically vulcanized thermoplastic elastomers include "SANTOPRENE", and "SARLINK", commercially available from Advanced Elastomer Systems. Examples of suitable functionalized styrene-butadiene elastomers, include "KRATON" FG-1901x and FG-1921x, which are available from the Shell Corporation. Examples of suitable thermoplastic polyurethanes include "ESTANE" 58133 and "ESTANE" 58144, which are commercially available from the B. F. Goodrich Company. Further, the materials for the mantle layer described above may be in the form of a foamed polymeric material. For example, suitable metallocene polymers include foams of thermoplastic elastomers based on metallocene single-site catalyst-based foams.

Additionally, the mantle layer may be a blend of a first and a second thermoplastic, wherein the first thermoplastic is a thermoplastic copolyetherester or copolyesterester block copolymer, a dynamically vulcanized thermoplastic elastomer, a functionalized styrene-butadiene elastomer, a thermoplastic polyurethane or a metallocene polymer and the second thermoplastic is a material such as a thermoplastic polyurethane, a thermoplastic polyetherester or polyetheramide, a thermoplastic ionomer resin, a thermoplastic polyester, another dynamically vulcanized elastomer, another functionalized styrene-butadiene elastomer, another metallocene polymer or blends thereof.

Suitable thermoplastic polyetheramides include "PEBAX" 2533, "PEBAX" 1205 and "PEBAX" 4033 which are available from Elf-Atochem of Philadelphia, Pa. Suitable thermoplastic ionomer resins include any number of olefinic based ionomers including "SURLYN" and "IOTEK", which are commercially available from DuPont and Exxon, respectively. Suitable thermoplastic polyesters include polybutylene terephthalate.

Likewise, the dynamically vulcanized thermoplastic elastomers, functionalized styrene-butadiene elastomers, thermoplastic polyurethane or metallocene polymers identified above are also useful as the second thermoplastic in such blends. Further, the materials of the second thermoplastic described above may be in the form of a foamed polymeric material.

In addition to their use in golf ball centers, fillers can also be added to the mantle layer composition or both ball portions to increase the density of the core to conform to uniform golf ball standards. Fillers may also be used to modify the weight of the core for specialty balls used by players, e.g., a lower weight core is preferred for a player having a low swing speed. Fillers typically include processing aids or compounds to affect rheological and mixing properties, the specific gravity, the modulus, the tear strength, reinforcement, and the like. The fillers are generally inorganic, and suitable fillers include numerous metals and metal oxides, such as zinc oxide and tin oxide, and barium sulfate, calcium carbonate, barium carbonate, clay, tungsten, tungsten carbide, tungsten oxide, silicas, and the like. The fillers, when used, may be present in an amount of about 0.5 to 50 weight percent of the composition.

Figure 2:
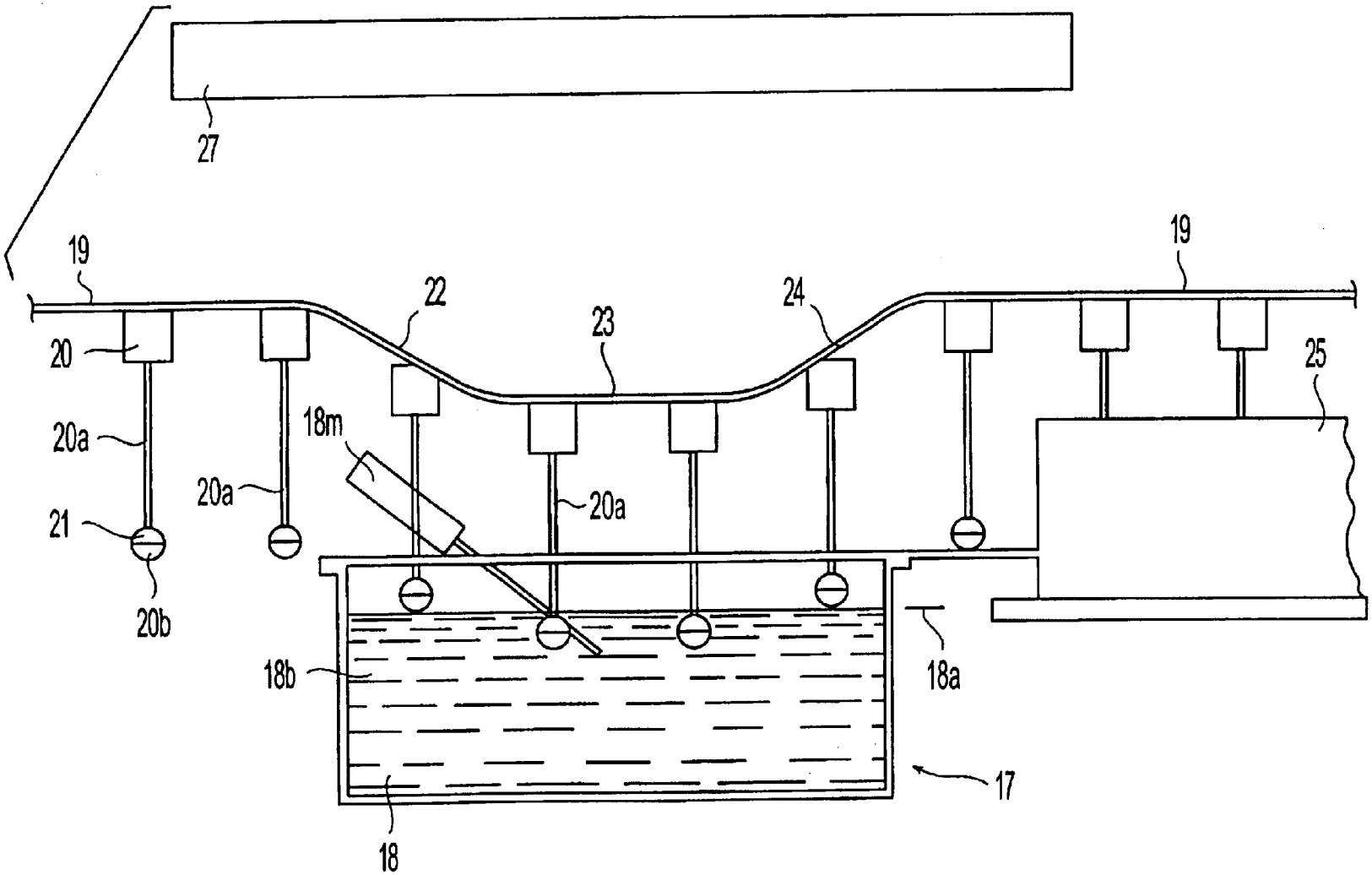
FIG. 2 is an elevational view of such apparatus.
Figure 3:
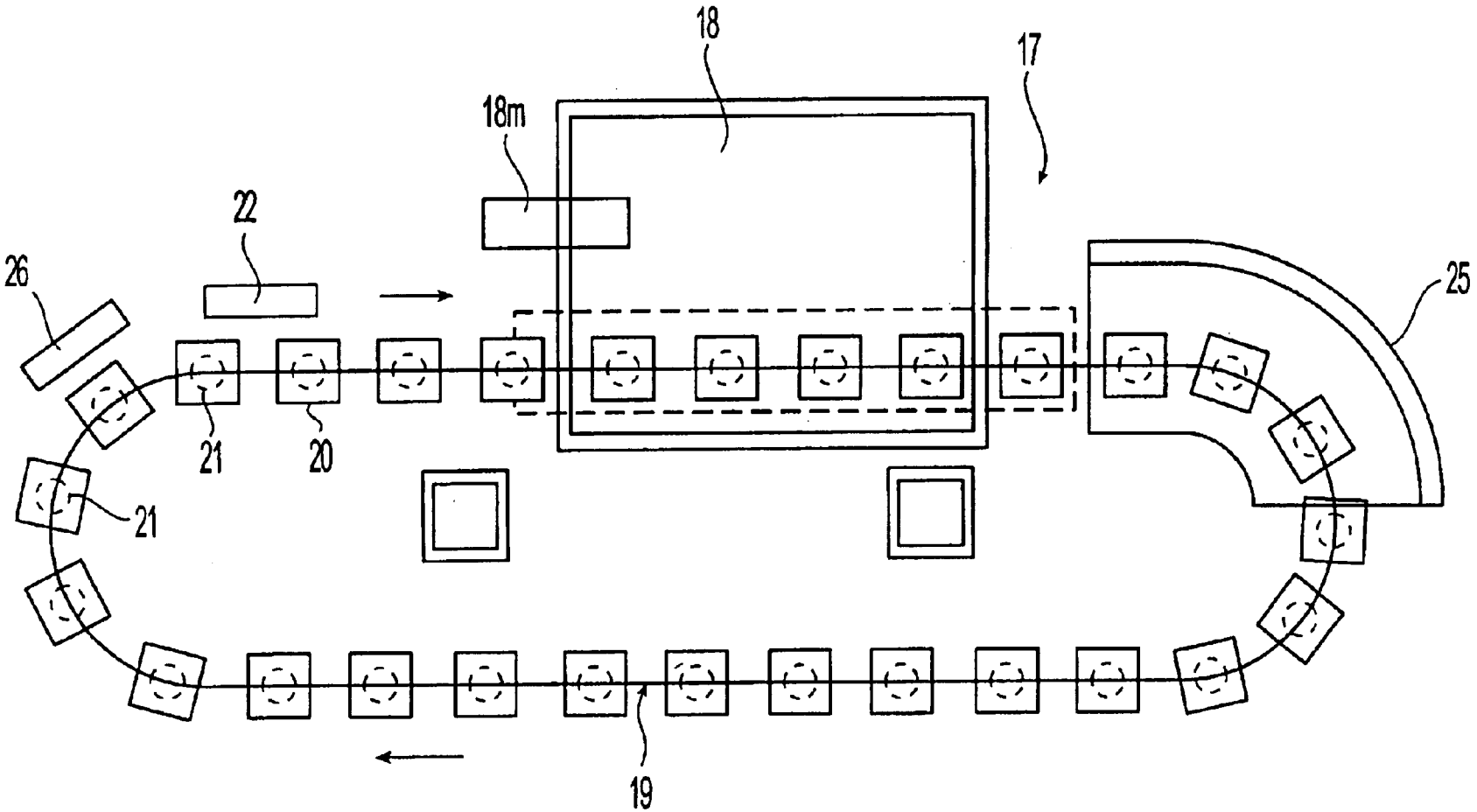
FIG. 3 is a plan view of the core-treating apparatus.

Turning to FIGS. 2 and 3, the dipping apparatus 17 includes a dip tank 18 filled to level 18*a* and agitated by electric mixer 18*m*. Apparatus 17 also includes oval conveying rack 19 with ball core carriers 20. Dip tank 18 is filled with latex bath 18*b* to level 18*a* and, if latex has been in tank 18 for a substantial length of time, initial mixing of bath 18*b* in tank 18 can be carried out until uniformity of bath 18*b* is reached. After such mixing golf ball cores 21 are loaded at loading station 22 into holding carriers 20 each comprising a stem 20*a* and a holder ring 20*b*. Loaded carriers 20 are carried by conveying rack 19 along and down to dip centers 21 for 1 to 60 seconds into latex bath 18*b*. Rack 19 moves through a descending portion 23, dipping portion 24 and ascending portion 25 of the carrier circuit to accomplish the latex dip core treatment. In solid cores the latex forms an encapsulating coating on the core of about 0.0005 inches to about 0.01 inches thick.

After the ball centers 21, for example, exit dip tank 18, they pass into a curing chamber 26 in which heat, ultraviolet rays, or other means for accelerating cure may be applied. It will be understood that some latex bath materials cure sufficiently under ambient conditions that curing chamber 26 is not required.

Depending on the nature of the latex material applied, the golf ball dip-treated portions can then be stored for a period of time for additional cure, or, if the latex material is sufficiently cured at this point, the latex dip-encapsulate ball portion can be transported directly to the molding area for molding of the outer cover layer or other cover material.

Since some latex materials generate fumes in the dip tank 18, it is preferred to have a vacuum hood 27 positioned above the dip tank 18. The vacuum hood 27 is preferably provided with means (not shown) for generating a clean air curtain about the periphery of the dip tank 18 to prevent escape of undesirable gasses. The curing chamber 26 can also be provided with suitable gas removal means.

The thermosetting latex materials that are useful in the one or more intermediate layers of the present invention are any materials that will withstand the temperatures at which the mantle materials are molded, particularly in situations where the mantle is molded directly adjacent the thermosetting latex material(s). It should be understood that these latex or other soft materials may be used in a core layer, intermediate layer, or a cover layer, but preferably they are included in an intermediate layer or used to form at least one intermediate layer. Typical thermosetting latex materials that can be used to coat the cores include low ammonia natural latex and/or pre-vulcanized natural latex. Natural latex is noted for its combination of high tensile strength, excellent elasticity, tack, low modulus, and ability to form strong, coherent, wet and dry films. These characteristics make it ideal for manufacturing dipped articles and no other polymer substitute has been found which possesses all of these properties.

Preferred latex materials, such as "HARTEX" 101 or "HARTEX" 103 from Firestone, of Akron, Ohio, or "HEVEATEX" H1704 pre-vulcanized natural latex, are partially pre-vulcanized natural latexes that can be diluted with water to any solid content. It is understood that non-latex encapsulating materials may also be used. Such materials include elastomer adhesives as well as aqueous and non-aqueous adhesives, and are represented by the following, but noninclusive examples. Elastomer adhesives, such as a "CHEMLOK" 252H, are sold by the Lord Corporation; urethane dispersions, such as "AQUATHANE", are sold by Reichhold Chemicals, Inc.; aqueous adhesives, such as "CHEMLOK" EP6962-62, are sold by the Lord Corporation; non-aqueous adhesives, such as "SILAPRENE" DC-11687, are sold by the Uniroyal Technology Corporation; synthetic latexes, such as carboxylated "NBR" latex and "THIXON", are sold by Reichhold Chemicals, Inc., Morton International; and Guardsman Chemicals, Inc, respectively. Alkyd resins, such as "VPI" alkyd resin, are sold by the Ball Chemical Company.

Other materials that could be suitable for the soft, intermediate layer, include aqueous acrylic and latex copolymers, such as "RHOPLEX" 2438 emulsion, "RHOPLEX" E-32 NP emulsion, and many commercial products, many of which have properties that suggest use as the soft intermediate layer developed herein.

The soft intermediate layer may also contain additives, fillers, thickeners, or a combination thereof, to adjust the specific gravity of the layer to alter various golf ball properties as needed or desired. "RENACIT" 7 is a peptizer produced by Miles, Inc of Pittsburgh, Pa., that is a pentachlorothiophenol mixture containing Kaolin, quartz, and mineral oil. Materials such as "RENACIT" 7 can be used to alter the properties of the inner surface of the mantle layer. Specifically, it can be used to soften the inner surface. Fillers may also be added to the intermediate layer. Fillers typically include processing aids or compounds to affect rheological and mixing properties, the specific gravity, the modulus, the tear strength, reinforcement, and the like. Suitable fillers include the same fillers described herein for use in the core or center. Preferably, fillers, when used in the intermediate layer, may be present in an amount of about 0.5 to 50 weight percent of the composition. In one preferred embodiment, the filler is present in an amount of about 0.5 to 20 weight percent. In one preferred embodiment, the fillers include zinc oxide.

Film thickness is an important parameter to consider in the formation of the soft, elastomeric, intermediate layer. Film thickness of a natural or synthetic latex material can be controlled by adjusting parameters such as the time that the ball center remains in the latex bath or percent solids of the latex. Most commonly, controlling film thickness is accomplished by adjusting the weight percent of the total solids. For example, a low ammonia natural latex compound, such as "HARTEX" 101 or "HARTEX" 103 from Firestone, of Akron, Ohio, containing 30% solids using a 30-second dwell time produces a film thickness of 0.007 inches.

The intermediate layer can also include, or be formed entirely from, a responsive viscoelastic composition. These compositions include solids, semi-solids, gels, or gel-like materials that have a rheopectic, dilatant, or thixotropic viscosity that exhibit an increase in viscosity in response to shear forces, tensile forces, compressive strain, or a combination thereof. Indeed, the material can be formed as a coating or film disposed about a portion of a golf ball, preferably entirely surrounding the portion of the ball being coated;

or the material can be formed by any conventional golf ball layer forming method including compression, injection, or reaction injection molding, casting, or the like, depending upon the material. Preferably, the responsive viscoelastic composition forms at least one continuous layer of material. In this embodiment, the intermediate layer can be placed at any point in the ball between the inner layer of the core and the outer cover layer. In one preferred embodiment, the intermediate layer including responsive viscoelastic material is disposed between the mantle and the outer cover layer, while in another it is disposed directly adjacent the core.

Without being bound by theory, it is believed that the material provides for low resistance to low shear stresses from low clubhead speeds, but higher resistance to high shear stresses from a higher clubhead speeds. Immediate responses are dilatant, while delayed responses that are time dependent are considered rheopectic. Preferably, the response is dilatant, or immediately upon application of the shear stress. The response of the responsive viscoelastic material is reversible. As a result, it is believed that a golf ball having a high effective modulus and a relatively hard compression would effectively have a softer compression, more distortion from a lower effective modulus, and a softer feel when struck at a low clubhead speed. Such a golf ball according to the invention advantageously has the properties desired by both beginning and more advanced players, since the ball's properties will be varied depending upon the swing speed of the golf club when it strikes the ball of the invention.

Suitable responsive viscoelastic compositions include polysiloxane compositions, such as dilatant silicone composition 3179 available from Dow Corning and described in U.S. Pat. No. 2,541,851, the disclosure of which is incorporated herein by reference thereto. Such materials have high elasticity, a high COR. Preferred polysiloxane compounds typically have a plasticity of about 20 mils to 150 mils, preferably of about 60 mils to 120 mils, and more preferably of about 65 mils to 100 mils, as measured by ASTM D-926. Preferred polysiloxane compounds also preferably have a specific gravity of 1.1 to 1.18 g/cm$^3$. In one embodiment, the tensile strength of the silicones is from about 10 psi to 250 psi, while in another embodiment, the tensile strength is from about 800 psi to 100,000 psi. In one preferred embodiment, the tensile strength of the silicone material is from about 1000 psi to 10,000 psi. Preferred polysiloxane compositions include polydimethyl siloxane, dimethyl cyclosiloxane, a hydoxy-terminated polydimethyl siloxane polymers. These polysiloxane compositions can also include one or more inert additives, such as $TiO_2$, silica, quartz, boric acid, glycerine, and the like.

Additional suitable responsive viscoelastic compositions include essentially uncured polybutadiene, or lightly cured polybutadiene having a low level of peroxide, zinc oxide and less than about 10 phr of zinc diacrylate or another $\alpha,\beta$-unsaturated carboxylic acid or derivative thereof. "Low level" of peroxide typically refers to less than about 5 percent, preferably less than about 1 percent, more preferably less than about 0.1 percent, and most preferably less than about 0.05 percent of peroxide. The uncured polybutadiene may optionally be blended with up to about 50 percent by weight of trans-polyisoprene (synthetic), balata (natural trans-polyisoprene), polyoctenamer, or any of the other rigidifying polymers described herein, or a combination thereof, to facilitate molding or other desirable processing or final product characteristics. In one embodiment, the rigidifying polymer is present in an amount of about 10 to 40 weight percent, while in another embodiment it is present in an amount of about 20 to 30 weight percent.

Other suitable responsive viscoelastic compositions for use according to the invention include: (a) the oil containing resins described in U.S. Pat. No. 4,829,093, as well as combinations of one or more oil-containing copolymers and one or more thermoplastic resins; (b) modeling dough compositions described in U.S. Pat. Nos. 5,498,645; 5,171,766; 5,506,280; 5,364,892; 5,972,092, with or without hollow microspheres; (c) copolymer dispersions having a narrow particle dispersion as described in U.S. Pat. Nos. 4,371,636; 4,654,396; and 5,037,880, which contain unsaturated carboxylic acids (acrylic acid, methacrylic acid, and the like), a monoolefinically unsaturated monomer (vinyl esters such as styrene, esters of acrylic acids with alkanols, and the like), and additives (emulsifiers, dispersants, and the like); (d) dilatant compositions including a plurality of particulates, one or more non-volatile emollients, and gelling agent(s), as described in U.S. Pat. No. 5,883,382; (e) synthetic resin dispersions stabilized by protective colloids, such as those described in U.S. Pat. No. 5,679,735; (f) Organosol gels of controlled rigidity, which typically include a high MW thermoplastic core, as described in U.S. Pat. No. 5,698,616; (g) a solution of a sulfonated polystyrene ionomer or sulfonated EPDM or butyl rubber ionomer, such as disclosed in U.S. disclosure H363; (h) sodium tetraborate crosslinked polyvinylacetate compositions; (i) gellants based on oil-based well bore fluids, as disclosed in U.S. Pat. No. 5,021,170; (j) a hydrocarbon-based gel, a sulfonate ionomer, or blends thereof, such as disclosed in U.S. Pat. No. 4,536,310; (k) acrylic plastisols or organosols, such as disclosed in U.S. Pat. No. 4,465,572, such as photosensitive thermally coalescible acrylic plastisols or organosols; (l) responsive gels that meet the responsive viscoelastic composition disclosed herein, as disclosed in U.S. Pat. No. 5,827,459; and the like, including polyvinyl alcohol, an ionized crosslinked polyacrylamide gel, a microporous fast-response gel, a thermoplastic elastomer gel, or a blend thereof. The disclosure of each of the above patents is incorporated herein by express reference thereto. Further, one of ordinary skill in the art aware of such materials will be readily able to include them in golf balls prepared according to the invention. Combinations of any suitable responsive viscoelastic compositions with each other or conventional materials are also contemplated.

When non-responsive viscoelastic materials are included in the composition, they are typically present in an amount of less than about 50 weight percent of the composition. In various embodiments, such non-responsive viscoelastic materials are present in amounts less than about 20 weight percent, less than about 10 weight percent, less than about 5 weight percent, less than about 1 weight percent, and less than about 0.1 weight percent.

While some of the responsive viscoelastic compositions described herein are difficult to process, i.e., are very viscous liquids or gels, or tacky solids, they may be encased in a thin film of a material that renders the composition(s) more suitable for processing. For example, the materials can be cast onto the inner surface of half shells of an outer cover material for subsequent compression molding.

Any of the responsive viscoelastic compositions can be modified with various conventional additives, so long as the additive(s) do not substantially reduce the responsive properties of the material. For example, a density-modifying filler, fiber, flake, particulate, thermoplastic, or glass microballoon may be included, as well as any of the other suitable fillers described herein with respect to other layers of the golf ball. Various fillers described in U.S. Pat. Nos. 6,127,457; 5,895,805; 5,607,993; and 5,202,362 can be included individually or in any combination, and these patent disclosures are incorporated herein by express reference thereto.

In one embodiment, FIG. 1 depicts a golf ball having an inner core 14, an outer core 15, an intermediate layer 16 formed of a responsive viscoelastic composition, and a cover 11. Although it should be understood that the invention encompasses covers having multiple layers, this embodiment depicts a cover 11 having a single layer. Also, the inner and outer core layers 14, 15 could be produced as a single unitary core (not depicted).

In another embodiment, FIG. 1 depicts golf ball 10 formed of a unitary core 14, an intermediate layer 15 formed of a responsive viscoelastic composition, an inner cover layer 16, and an outer cover layer 11. In yet another embodiment, FIG. 1 depicts a golf ball 10 formed of a core 14, an inner cover layer 15, an intermediate layer 16 formed of a responsive viscoelastic composition, and an outer cover layer 11. In each of the above shown embodiments of FIG. 1, it should be understood that the thicknesses are not necessarily drawn to scale. Also, with respect to each embodiment of the invention, the core can include one or more layers and be a solid, wound, fluid-filled, or any other type of construction available to one of ordinary skill in the art. In yet another embodiment (not shown), the golf ball of the invention includes a core, a first intermediate layer formed of a responsive viscoelastic composition, an inner cover layer, a second intermediate layer formed of a responsive viscoelastic composition, and a cover, each disposed in concentric fashion about the previous layer.

A first preferred embodiment includes a thin, stiff outer cover material of ionomer, high acid ionomer, polyamide, polyurethane, polyurethane ionomer, or the like having a shore D hardness of greater than about 60 and a thickness of about 0.001 inches to 0.03 inches, with an intermediate layer including the responsive viscoelastic composition disposed directly adjacent and inwardly of the outer cover layer and directly adjacent the core. The intermediate layer of this embodiment can have a thickness of about 0.03 inches to 0.1 inches. Also, the intermediate layer typically has a Shore D hardness of less than about 50, preferably a hardness of less than about 90 Shore A, and more preferably less than about 70 Shore A.

A second preferred embodiment is the same, but further includes an inner cover layer of the same materials, or even the same materials, between the core and the intermediate layer. In one embodiment, the outer cover layer includes a polyurethane, preferably a cast polyurethane material and the inner cover layer includes at least one ionomer. A third preferred embodiment is similar to the first, but the intermediate layer is disposed inwardly from both an inner and an outer cover layer. In various embodiment of this third preferred embodiment, the hardness of the inner and outer cover layers can be adjusted so that one layer is harder than the other.

Figure 4:
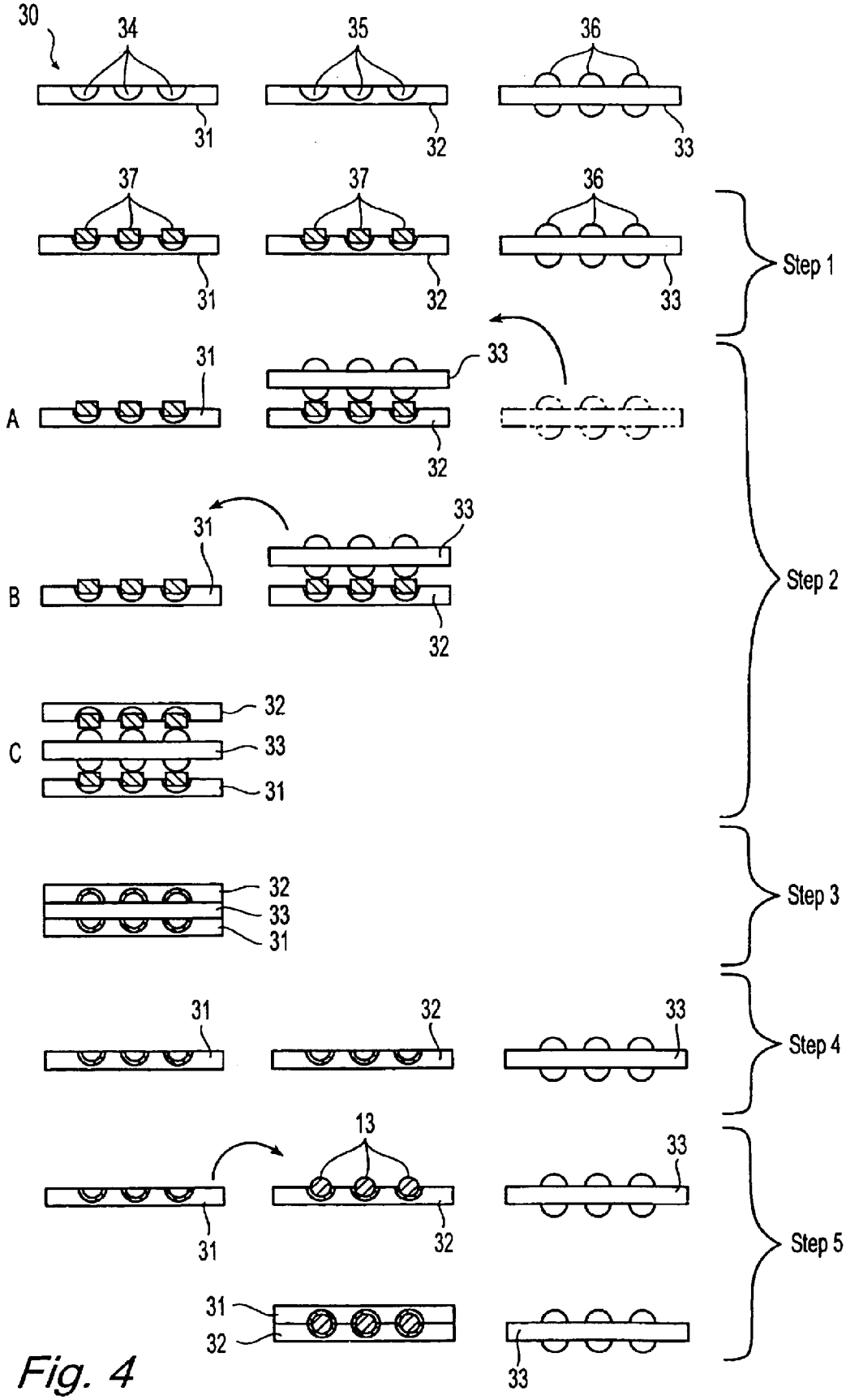
FIG. 4 is a flow chart of the method of forming an inner sphere according to the present invention.

Referring now to FIG. 4, the most preferred molding process uses a mold assembly 30 comprising a upper or top mold frame 31, a lower or bottom mold frame 32 and a center mold frame 33. The top and bottom mold frames 31 and 32 include a plurality of mating cavities 34 and 35 that form a sphere the size of a golf ball core as set forth above. The center mold frame 33 includes a plurality of protrusions 36 on opposite sides of the center mold frame for corresponding with the cavities 34 and 35 of the top and bottom mold frames. The protrusions 36 are hemispheres that are substantially the same size as one half of the ball center as set forth above.

First, as shown in Step 1, the mantle material such as polybutadiene preps 37 are placed in the cavities 34 and 35 of the top and bottom mold frames. Then referring to Step 2A, the center mold frame 33 is moved into alignment with the bottom mold frame 32 such that the protrusions 36 are located in alignment or coaxial with the cavities 35. However, the center mold frame 33 is positioned over the bottom mold frame 32 at such a height that the polybutadiene preps are only compressed enough to hold them in place. Then, as shown in Step 2B and 2C, the center mold frame 33 and the bottom mold frame 32 are moved into alignment with the top mold frame 31 such that the protrusions 36 and the cavities 34 and 35 are all in alignment. Again, the center mold frame 33 is spaced from the top mold frame 31 such that the preps in the top mold frame cavities 34 are only slightly compressed.

Once the mold assembly 30 is in position, the mold assembly 30 is placed into a press, heated and compressed, as shown in Step 3. Preferably, the mold assembly 30 is heated to a first temperature that makes the polybutadiene preps significantly more pliable, but is below the cure initiation points. Preferably, the temperature is greater than about 150° F., but less that the cure initiation point. The most preferred temperature is between about 190° F. and 220° F. The mold assembly 30 is compressed to a pressure sufficient enough to form hemispheres from the polybutadiene preps, as shown in Step 4. Preferably, the mold assembly is compressed to a pressure of about 700 psi to 1400 psi and, more preferably, it is compressed to a pressure of about 1000 psi. The mold is then cooled to about 60° F. to 100° F. and preferably, it is cooled to about 80° F.

After the mantle material, e.g., the polybutadiene preps, have been formed into hemispheres, the mold assembly is removed from the press and the top mold frame 31, bottom mold frame 32 and the center mold frame 33 are moved out of alignment, as shown in Step 4. Then, turning to Step 5, the ball centers 13 with intermediate layer 15 (See FIG. 1) are placed within the hemispheres located in the bottom mold frame 32. The top mold frame 31 is moved into alignment with the bottom mold frame such that the mantle hemispheres form a sphere around the ball centers 13. Then the top and bottom mold frames 31 and 32 are placed back into the press, heated and compressed again. This time, the top and bottom mold frames are heated to a temperature above the cure initiation for the polybutadiene forming the mantle preps. Preferably, the mold frames are heated to a temperature of greater than about 290° F. and are compressed a pressure of greater than about 2000 psi.

Referring to FIG. 1, the cover 11 provides the interface between the ball 10 and a club. Properties that are desirable for the cover are good moldability, high abrasion resistance, high tear strength, high resilience, and good mold release, among others.

The cover 11 can be comprised of polymeric materials such as ionic copolymers of ethylene and an unsaturated monocarboxylic acid which are available under the trademark "SURLYN" of E. I. DuPont de Nemours & Company of Wilmington, Del. or "IOTEK" or "ESCOR" from Exxon. These are copolymers or terpolymers of ethylene and methacrylic acid or acrylic acid partially neutralized with zinc, sodium, lithium, magnesium, potassium, calcium, manganese, nickel or the like.

In accordance with the preferred balls, the cover 11 has a thickness to generally provide sufficient strength, good performance characteristics and durability. Preferably, the cover 11 is of a thickness from about 0.03 inches to about 0.12 inches. More preferably, the cover 11 is about 0.04 to 0.09 inches in thickness and, most preferably, is about 0.05 to 0.085 inches in thickness.

In one preferred embodiment, the cover 11 can be formed from mixtures or blends of zinc, lithium and/or sodium ionic copolymers or terpolymers.

The "SURLYN" resins for use in the cover 11 are ionic copolymers or terpolymers in which sodium, lithium or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The covers of this invention may comprise homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes such as those prepared from polyols and diisocyanates or polyisocyanates and those disclosed in U.S. Pat. No. 5,334,673.

(4) Polyureas such as those disclosed in U.S. Pat. No. 5,484,870.

(5) Polyamides such as poly(hexamethylene adipamide) and others prepared from diamines and dibasic acids, as well as those from amino acids such as poly (caprolactam), and blends of polyamides with Surlyn, polyethylene, ethylene copolymers, ethyl-propylene-non-conjugated diene terpolymer, etc.

(6) Acrylic resins and blends of these resins with poly vinyl chloride, elastomers, etc.

(7) Thermoplastics such as the urethanes, olefinic thermoplastic rubbers such as blends of polyolefins with ethylene-propylene-non-conjugated diene terpolymer, block copolymers of styrene and butadiene, isoprene or ethylene-butylene rubber, or copoly(ether-amide), such as "PEBAX" sold by Elf-Atochem of Philadelphia, Pa.

(7) Polyphenylene oxide resins, or blends of polyphenylene oxide with high impact polystyrene as sold under the trademark "NORYL" by General Electric Company, Pittsfield, Mass.

(8) Thermoplastic polyesters, such as polyethylene terephthalate, polybutylene terephthalate, polyethylene terephthalate/glycol modified and elastomers sold under the trademarks "HYTREL" by E. I. DuPont de Nemours & Company of Wilmington, Del. and "LOMOD" by General Electric Company, Pittsfield, Mass.

(9) Blends and alloys, including polycarbonate with acrylonitrile butadiene styrene, polybutylene terephthalate, polyethylene terephthalate, styrene maleic anhydride, polyethylene, elastomers, etc. and polyvinyl chloride with acrylonitrile butadiene styrene or ethylene vinyl acetate or other elastomers. Blends of thermoplastic rubbers with polyethylene, propylene, polyacetal, nylon, polyesters, cellulose esters, etc.

Preferably, the cover 11 is comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly (tetrafluoroethylene) and their copolymers including functional comonomers and blends thereof. Still further, the cover 11 is preferably comprised of a polyether or polyester thermoplastic urethane, a thermoset polyurethane, an ionomer such as acid-containing ethylene copolymer ionomers, including E/X/Y terpolymers where E is ethylene, X is an acrylate or methacrylate-based softening comonomer present in 0 to 50 weight percent and Y is acrylic or methacrylic acid present in 5 to 35 weight percent. More preferably, in a low spin rate embodiment designed for maximum distance, the acrylic or methacrylic acid is present in 15 to 35 weight percent, making the ionomer a high modulus ionomer. In a high spin embodiment, the cover includes an ionomer where an acid is present in 10 to 15 weight percent and includes a softening comonomer.

Although preferred embodiments of the invention have been illustrated in the accompanying drawings and described in the foregoing Detailed Description, it will be understood that the invention is not limited to the embodiments disclosed, but is capable of numerous rearrangements and modifications of parts and elements without departing from the spirit of the invention.

What is claimed is:

1. A multi-layer golf ball comprising:

a core comprising:

a center;

an intermediate layer formed around the center, the intermediate layer having a thickness of about 0.0008 inches to 0.002 inches and a flexural modulus of less than about 10,000 psi;

a mantle comprising at least one layer, the layer comprising a resilient polymer component, wherein the mantle is disposed concentrically adjacent the intermediate layer; and at least one cover layer disposed concentrically around the mantle;

wherein the intermediate layer comprises low ammonia natural latex and/or pre-vulcanized natural latex, elastomer adhesives, urethane dispersions, aqueous and non-aqueous adhesives, synthetic latexes, alkyd resins, acrylic and latex copolymers, polyurethane coatings, or mixtures thereof.

2. The ball of claim 1, wherein the intermediate layer has a Shore A hardness less than about 90.

3. The ball of claim 2, wherein the intermediate layer has a Shore A hardness less than about 70.

4. The ball of claim 1, wherein the intermediate layer has a flexural modulus less than about 3,000 psi.

5. The ball of claim 1, wherein the center has an outer diameter of about 0.5 inches to 1.35 inches.

6. The ball of claim 5, wherein the center has an outer diameter of about 0.75 inches to 1.25 inches.

7. The ball of claim 1, wherein a combination of the center, the soft elastic intermediate layer, and the mantle has an outer diameter of about 1.45 inches to 1.6 inches.

8. The ball of claim 7, wherein a combination of the center, the soft elastic intermediate layer, and the mantle has an outer diameter of about 1.5 inches to 1.58 inches.

9. The ball of claim 1, wherein the center is solid, or filled with a liquid, a gel, a foam, or a gas.

10. The ball of claim 1, wherein the mantle layer comprises a reinforcing polymer component.

11. The ball of claim 1, wherein the resilient polymer component of the mantle layer comprises polybutadiene, natural rubber, polyisoprene, styrene-butadiene, or styrene-propylene-diene rubber.

12. The ball of claim 11, wherein the resilient polymer component comprises 1,4-cis-polybutadiene having a molecular weight average of about 50,000 to 1,000,000.

13. The ball of claim 11, wherein the amount of resilient polymer component is between about 60 to 99 weight percent of the total weight of polymer components.

14. The ball of claim 11, further comprising at least one of a filler, a free radical initiator, or a crosslinking agent.

15. The ball of claim 11, wherein the mantle layer has a flexural modulus of greater than about 3.5 MPa.

16. The ball of claim 1, wherein the center is a solid center, wherein the solid center comprises a resilient polymer component.

17. The ball of claim 16, wherein the solid center comprises polybutadiene, natural rubber, polyisoprene, styrene-butadiene, or styrene-propylene-diene rubber.

18. The ball of claim 1, wherein the intermediate layer is comprised of a natural or a synthetic latex material.

19. The ball of claim 1, wherein the intermediate layer is comprised of additives, fillers, thickeners, or a combination thereof.

20. The ball of claim 1, wherein the filler is zinc oxide and is present in an amount of about 0.5 to 20 weight percent.

21. A multi-layer golf ball comprising:

a core comprising:

a center;

an intermediate layer formed around the center, the intermediate layer being less than about 0.01 inches thick and having a Shore A hardness less than about 70 and a flexural modulus of less than about 10,000 psi;

a mantle comprising at least one layer, the layer comprising a resilient polymer component, wherein the mantle is disposed concentrically adjacent the intermediate layer; and at least one cover layer disposed concentrically around the mantle;

wherein the intermediate layer comprises low ammonia natural latex and/or pre-vulcanized natural latex, elastomer adhesives, urethane dispersions, aqueous and non-aqueous adhesives, synthetic latexes, alkyd resins, acrylic and latex copolymers, polyurethane coatings, or mixtures thereof, and wherein the resilient polymer component of the mantle layer comprises polybutadiene, natural rubber, polyisoprene, styrene-butadiene, or styrene-propylene-diene rubber.

22. The ball of claim 21, wherein the intermediate layer thickness is about 0.0005 inches to 0.01 inches.

23. The ball of claim 22, wherein the intermediate layer thickness is about 0.0008 inches to 0.002 inches.

24. The ball of claim 21, wherein the intermediate layer has a flexural modulus less than about 3,000 psi.

25. The ball of claim 21, wherein the center has an outer diameter of about 0.5 inches to 1.35 inches.

26. The ball of claim 25, wherein the center has an outer diameter of about 0.75 inches to 1.25 inches.

27. The ball of claim 21, wherein a combination of the center, the soft elastic intermediate layer, and the mantle has an outer diameter of about 1.45 inches to 1.6 inches.

28. The ball of claim 27, wherein a combination of the center, the soft elastic intermediate layer, and the mantle has an outer diameter of about 1.5 inches to 1.58 inches.

29. The ball of claim 21, wherein the center is solid, or filled with a liquid, a gel, a foam, or a gas.

30. The ball of claim 21, wherein the mantle layer comprises a reinforcing polymer component.

31. The ball of claim 21, wherein the center is a solid center, wherein the solid center comprises a resilient polymer component.

32. The ball of claim 31, wherein the solid center comprises polybutadiene, natural rubber, polyisoprene, styrene-butadiene, or styrene-propylene-diene rubber.

33. The ball of claim 21, wherein the resilient polymer component comprises 1,4-cis-polybutadiene having a molecular weight average of about 50,000 to 1,000,000.

34. The ball of claim 21, wherein the amount of resilient polymer component is between about 60 to 99 weight percent of the total weight of polymer components.

35. The ball of claim 21, further comprising at least one of a filler, a free radical initiator, or a crosslinking agent.

36. The ball of claim 21, wherein the mantle layer has a flexural modulus of greater than about 3.5 MPa.

37. The ball of claim 21, wherein the intermediate layer is comprised of a natural or a synthetic latex material.

38. The ball of claim 21, wherein the intermediate layer is comprised of additives, fillers, thickeners, or a combination thereof.

39. The ball of claim 21, wherein the filler is zinc oxide and is present in an amount of about 0.5 to 20 weight percent.

* * * * *